US005931299A

United States Patent [19]

Hsieh

[11] Patent Number: 5,931,299

[45] Date of Patent: Aug. 3, 1999

[54] TOOLHOLDER

[76] Inventor: Chih-Ching Hsieh, No. 64, Lane 107, Liang Tsun Rd., Fong Yuan City, Taichung Hsien, Taiwan

[21] Appl. No.: 09/229,761

[22] Filed: Jan. 14, 1999

[51] Int. Cl.[6] ..... B65D 85/28

[52] U.S. Cl. ..... 206/376; 206/480

[58] Field of Search ..... 206/372, 373, 206/376, 477, 486, 480, 482

[56] References Cited

U.S. PATENT DOCUMENTS 5,036,975 8/1991 Chow ..... 206/376

5,346,063 9/1994 Chow ..... 206/376

5,505,316 4/1996 Lee ..... 206/376 X

*Primary Examiner*—Jacob K. Ackun

*Attorney, Agent, or Firm*—Varndell Legal Group

[57] ABSTRACT

A tool holder having a handle at one end of a flat base thereof for carrying by hand or hanging on the wall, parallel ribs of different lengths raised from the flat base and defining a plurality of tool receiving grooves, a plurality of retainer blocks respectively raised from the flat base adjacent to one end of each tool receiving groove and a plurality of springy retainer rods suspended in respective side notches at the ribs at two opposite sides of each tool receiving groove remote from the retainer blocks for holding down storage tools in the tool receiving groove.

1 Claim, 4 Drawing Sheets

TOOLHOLDER

BACKGROUND AND SUMMARY OF THE INVENTION

The present invention relates to a tool older for holding tools, and more particularly to such a tool holder that can be conveniently carried by hand or hung on the wall to hold storage tools in good order, enabling storage tools to be shown out.

A variety of tool boxes and tool holders have been disclosed for keeping tools and tool accessories, and have appeared on the market. FIG. 1 shows a tool box specifically designed for keeping combination wrenches. This structure of tool box comprises two cover shells hinged together, each cover shell is mounted with a flat tool mount, which comprises a plurality of ribs of different lengths arranged in parallel and defining a plurality of tool receiving grooves for holding combination wrenches. When storing a combination wrench, the handle of the combination wrench is press fitted into one tool receiving groove. Because storage combination wrenches are retained to the respective tool receiving grooves by friction force, they tend to be forced out of the respective tool receiving grooves when the tool box is vibrated. Furthermore, this structure of tool box is not suitable for hanging on the wall to let storage combination wrenches be shown out.

A tool holder according to the present invention comprises a loop-like handle at one end of a flat base thereof for carrying by hand or hanging on the wall. The flat base comprises parallel ribs of different lengths raised from its one side and defining a plurality of tool receiving grooves, a plurality of retainer blocks respectively raised from the flat base adjacent to one end of each tool receiving groove and a Plurality of springy retainer rods suspended in respective side notches at the ribs at two opposite sides of each tool receiving groove remote from the retainer blocks for holding down storage combination wrenches in the tool receiving grooves. By means the loop-like handle, the tool holder can be hung on the wall to let storage combination wrenches be shown out.

DETAILED DESCRIPTION OF THE PREFERRED EMBODIMENT

Figure 1:
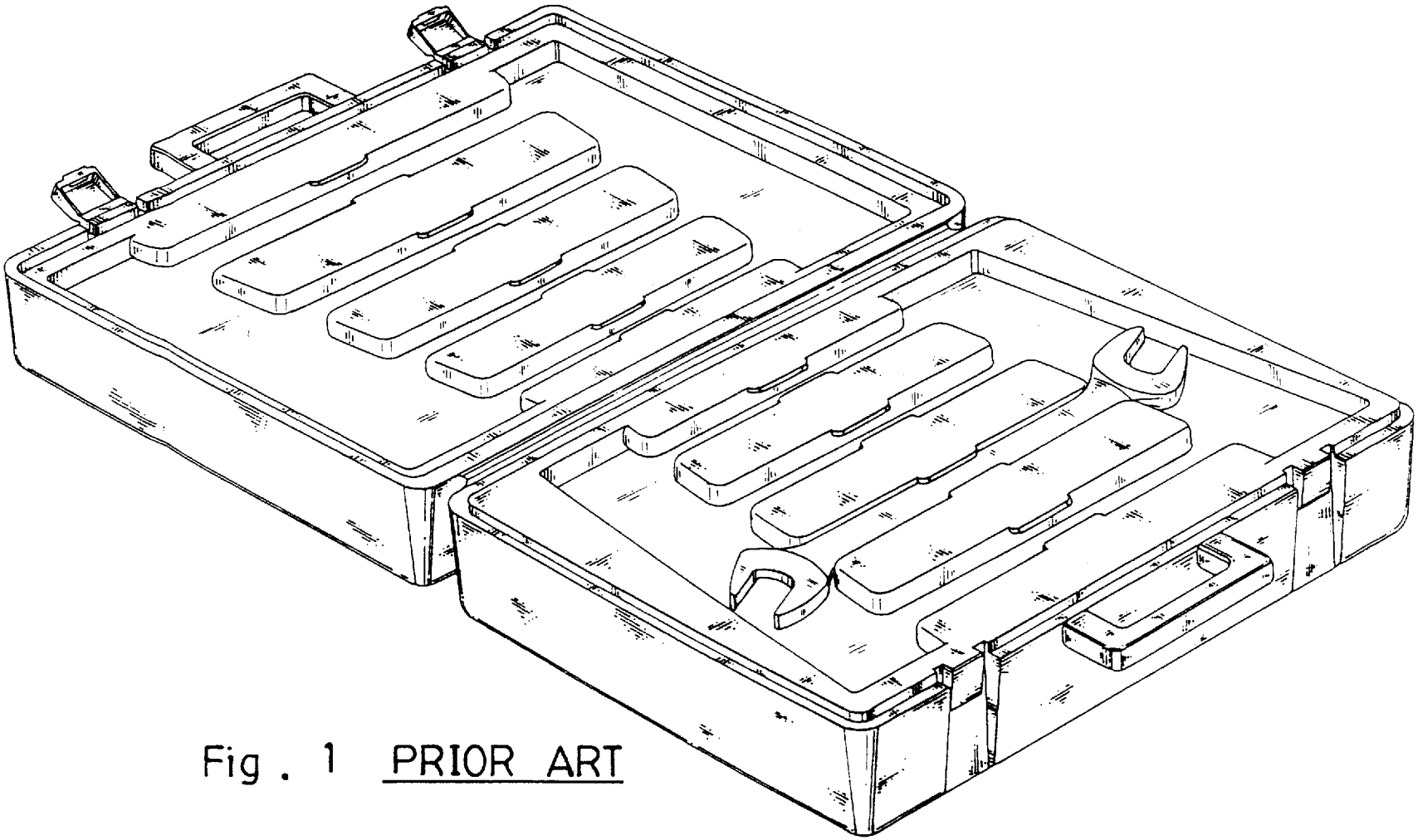
Fig. 1 PRIOR ART
FIG. 1 shows a tool box extended out according to the prior art.

Referring to Figures from 2 through 4, a tool holder in accordance with the present invention comprises a flat base

1, a loop-like handle 11 integral with one end of the flat base 1, a plurality of locating ribs 12 and 12' of different lengths transversely raised from the flat base 1 and arranged in parallel in a good order subject to their lengths, a plurality of transverse tool receiving grooves 13 respectively defined between each two adjacent locating ribs 12 and 12' for receiving a full set of combination wrenches 2.

Figure 2:
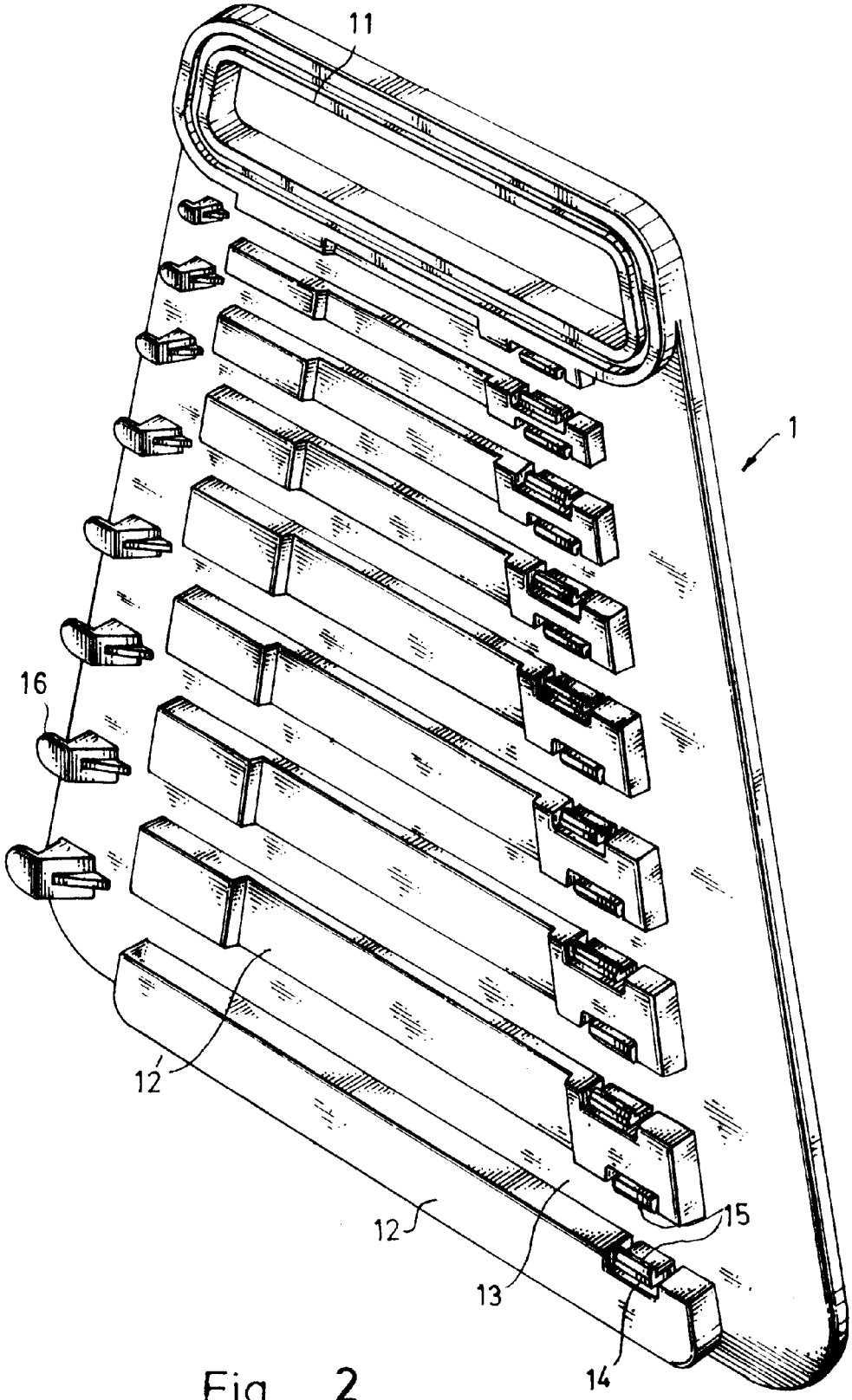
FIG. 2 is a perspective view of a tool holder according to the present invention.
Figure 4:
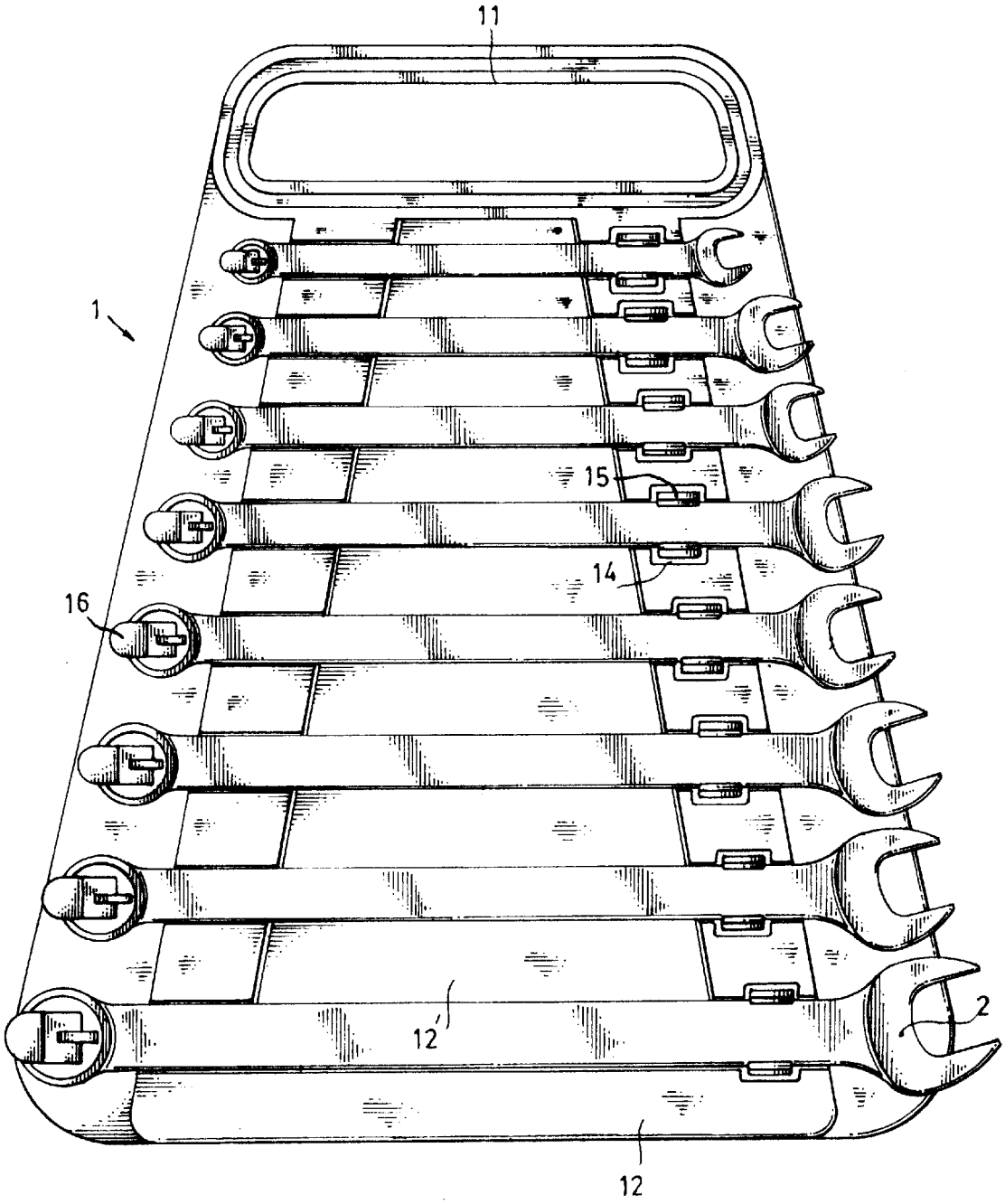
FIG. 4 is another applied view of the present invention, showing a set of combination wrenches mounted in the receiving grooves at the tool holder and arranged in good order.

Referring to FIGS. 2 and 4 again, a plurality of retainer blocks 16 are raised from the flat base 1 and longitudinally arranged in a line along one lateral side of the flat base 1 and facing the transverse tool receiving grooves 13 respectively, a plurality of side notches 14 are respectively provided at the locating ribs 12 and 12' near one end remote from the retainer blocks 16 and arranged in pair at two opposite sides of each transverse tool receiving groove 13, and a plurality of springy retainer rods 15 respectively suspended in the side notches 14 for holding down combination wrenches 2 in the tool receiving grooves 13.

Figure 3:
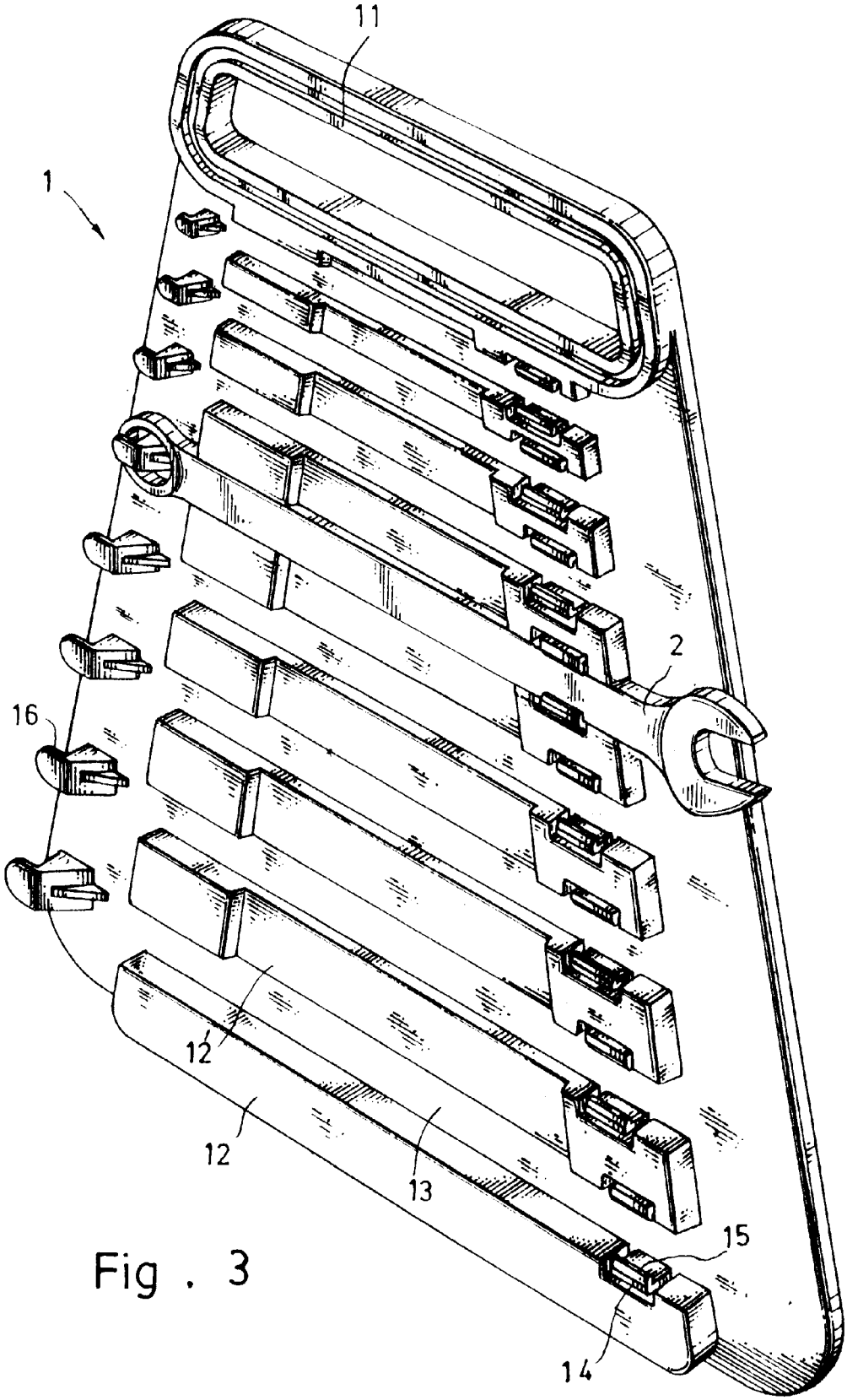
FIG. 3 is an applied view of the present invention, showing one combination wrench installed in one receiving groove at the tool holder.

Referring to FIGS. 3 and 4 again, when storing combination wrenches 2 in the tool receiving grooves 13, the box ends of the combination wrenches 2 are respectively hung on the retainer blocks 16, then the handles of the combination wrenches 2 are respectively set into the tool receiving grooves 13 and secured in place by the springy retainer rods 15. After installation of combination wrenches 2 in the tool receiving grooves 13, the tool holder can be carried by hand, or hung on the wall. Because each combination wrench 2 is hung on one retainer block 16 and held down in one tool receiving groove 13 by two springy retainer rods 15, storage combination wrenches 2 are firmly retained to the tool holder. When removing one combination wrench 2 from the tool holder, the open end of the combination wrenches 2 is lifted upwards from the flat base 1 to disengage the handle of the combination wrench 2 from the corresponding springy retainer rods 15, enabling the combination wrenches 2 to be conveniently disconnected from the corresponding retainer block 16. Because the tool holder is a flat member holding storage combination wrenches 2 on its one side and having a handle 11 at its one end, it can be hung on the wall, enabling storage combination wrenches 2 to be shown out.

I claim:

1. A tool holder comprising a flat base, a loop-like handle integral with one end of said flat base, a plurality of locating ribs of different lengths transversely raised from said flat base and arranged in parallel, and a plurality of transverse tool receiving grooves respectively defined between each two adjacent locating ribs for receiving a full set of combination wrenches, wherein a plurality of retainer blocks are raised from said flat base and longitudinally arranged in a line along one lateral side of said flat base and facing said transverse tool receiving grooves respectively for holding one end of a corresponding storage combination wrench, a plurality of side notches are respectively provided at said locating ribs near one end remote from said retainer blocks and arranged in pair at two opposite sides of each transverse tool receiving groove, and a plurality of springy retainer rods respectively suspended in said side notches for holding down storage combination wrenches in said tool receiving grooves.

* * * * *